US012172786B2

(12) United States Patent
Preihs et al.

(10) Patent No.: US 12,172,786 B2
(45) Date of Patent: Dec. 24, 2024

(54) CARBOARD PACKER, AND A FOLDING UNIT FOR A CARDBOARD PACKER

(71) Applicant: TETRA LAVAL HOLDINGS & FINANCE S.A., Pully (CH)

(72) Inventors: Mikael Preihs, Lund (SE); Björn Lineke, Lund (SE); Federico Zanichelli, Malmö (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 33 days.

(21) Appl. No.: 17/786,257

(22) PCT Filed: Dec. 18, 2020

(86) PCT No.: PCT/EP2020/087163
§ 371 (c)(1),
(2) Date: Jun. 16, 2022

(87) PCT Pub. No.: WO2021/123263
PCT Pub. Date: Jun. 24, 2021

(65) Prior Publication Data

US 2023/0025633 A1 Jan. 26, 2023

(30) Foreign Application Priority Data

Dec. 19, 2019 (EP) ..... 19218136

(51) Int. Cl.
*B65B 43/10* (2006.01)
*B65B 11/00* (2006.01)
(Continued)

(52) U.S. Cl.
CPC ..... *B65B 43/10* (2013.01); *B65B 11/004* (2013.01); *B65B 43/145* (2013.01); *B65B 49/12* (2013.01)

(58) Field of Classification Search
CPC ..... B65B 43/10; B65B 11/004; B65B 43/145; B65B 49/12; B31B 50/48; B31B 50/52;
(Continued)

(56) References Cited

U.S. PATENT DOCUMENTS 2,957,395 A * 10/1960 Meyer ..... B31B 50/52 493/453
3,021,768 A 2/1962 Oskar et al.
(Continued)

FOREIGN PATENT DOCUMENTS

CA 2771449 A1 2/2011
CN 102791584 A 11/2012
(Continued)

OTHER PUBLICATIONS

International Search Report (PCT/ISA/210) and Written Opinion (PCT/ISA/237) mailed on Mar. 9, 2021, by the European Patent Office as the International Searching Authority for International Application No. PCT/EP2020/087163. (14 pages).

*Primary Examiner* — Sameh Tawfik
(74) *Attorney, Agent, or Firm* — BUCHANAN INGERSOLL & ROONEY PC

(57) ABSTRACT

A flap folding unit is provided, comprising at least one flap folding device having a disc-like member being configured to be arranged in a first position to urge passing front flaps of an associated cardboard case to fold, and in a second position to allow unfolded rear flaps of the associated cardboard case to pass the disc-like member.

18 Claims, 11 Drawing Sheets

(51) Int. Cl.
*B65B 43/14* (2006.01)
*B65B 49/12* (2006.01)

(58) Field of Classification Search
CPC ..... B31B 50/262; B31B 50/50; B31B 50/56; B31F 1/0083; B31F 1/0016; B31F 1/0029
USPC ..... 493/183
See application file for complete search history.

(56) References Cited

U.S. PATENT DOCUMENTS 3,513,757 A * 5/1970 Di Frank ..... B65H 1/06 493/131
4,987,727 A 1/1991 Mcclusky et al.
5,148,654 A 9/1992 Kuesters
6,017,298 A * 1/2000 Baron ..... B31B 50/00 493/166
6,226,965 B1 * 5/2001 Lam ..... B65B 51/02 493/333
6,887,191 B2 * 5/2005 Bressler ..... B31B 50/00 53/376.4
7,445,589 B2 * 11/2008 Jaen ..... B31B 50/46 493/79
8,246,527 B2 * 8/2012 Wilkinson ..... B31B 50/262 493/70
10,155,352 B2 * 12/2018 Sytema ..... B31B 50/262
11,230,396 B2 * 1/2022 Koet ..... B31B 50/004
11,718,058 B2 * 8/2023 van der Dong ..... B31B 50/26 493/405
2012/0208687 A1 8/2012 Hanquist et al.
2012/0324833 A1 * 12/2012 Koch ..... B65B 21/24 53/558
2014/0011653 A1 * 1/2014 Fallas ..... B31B 50/26 493/183
2017/0190134 A1 * 7/2017 van der Dong ..... B65D 5/4266
2019/0160774 A1 5/2019 Langen

FOREIGN PATENT DOCUMENTS

DE 102010015865 A1 9/2011
EP 3015373 A1 5/2016

* cited by examiner

CARBOARD PACKER, AND A FOLDING UNIT FOR A CARDBOARD PACKER

TECHNICAL FIELD

The invention relates to a cardboard packer, in particular to a cardboard packer for producing boxes, trays, and/or wrap-around units for a plurality of carton packages. The invention also relates to a folding unit for such cardboard packer, as well as to a folding method for a cardboard packer.

BACKGROUND ART

Individual packaging containers, such as liquid food packaging containers, are typically produced from a carton-based material and filled using a high-speed filling machine. When the filled, formed, and sealed packaging containers are unloaded from the filling machine they are transferred to a cardboard packer in which a predetermined number of packaging containers are stacked in a packing pattern and placed in a case made from a cardboard blank.

The cardboard case, which may be in the form of a box, a tray, or a wrap-around unit is produced by folding the blank; the blank may e.g. be formed by cutting a corrugated cardboard sheet or the like into a predetermined shape. The shape of the blank varies in accordance with the dimension and number of packaging containers to be placed in the case, and the manner of packaging. In the case of a tray blank, the blank sheet has a shape to cover two opposing side surfaces of a group of packaging containers which have been stacked on the blank sheet in a predetermined packing pattern. In the case of a wrap-around blank, the blank sheet has a shape to wholly cover a group of packaging containers which have been stacked on the blank sheet in a predetermined packing pattern. For various types of cardboard cases, the cardboard blank comprises flaps which need to be folded in order to form the desired shape of the case.

An example of flap folding is described in CA2771449 by the same applicant. According to this disclosure, L-shaped flap folders are activated by a pneumatic actuator pushing the cardboard case upwards. During flap folding, the cardboard case is stationary in the machine feed direction.

Due to different customer requirements in terms of sizes and dimensions of the cardboard cases, the above-described prior art flap folders need to be adjusted accordingly if a producer decides to change the physical dimensions of the cases to be manufactured.

There is thus a need for an improved cardboard packer, and in particular for an improved flap folding unit, which can be used for different dimensions of the cardboard case.

SUMMARY

It is an object of the invention to at least partly overcome one or more of the above-identified limitations of the prior art. In particular, it is an object to provide a cardboard packer which allows for accurate folding of the flaps of the cardboard case, independently of the dimensions of the cardboard case.

According to a first aspect, a flap folding unit is provided. The flap folding unit comprises at least one flap folding device having a disc-like member being configured to be arranged in a first position to urge passing front flaps of an associated cardboard case to fold, and in a second position to allow unfolded rear flaps of the associated cardboard case to pass the disc-like member.

The disc-like member may comprise a convex portion and a recessed portion. Due to different geometries along a full revolution, engagement of the disc-like member with passing flaps can be controlled.

The convex portion may be a section having a circular periphery.

The disc-like member may be configured to rotate from its second position to its first position, thereby urging rear flaps of the associated cardboard case to fold.

The disc-like member may be connected to a link arm. The link arm may extend substantially parallel with a cardboard case feeder. In an embodiment, the link arm is pivotally supported.

The flap folding device may comprise two spaced apart flap folding devices. Hence, each flap folding device can cause folding of flaps on a specific side of the cardboard case.

The flap folding devices may consequently be arranged on opposite sides of a feeder (60).

Both flap folding devices may be driven by a common electrical motor. Further, a controller may be provided and configured to control rotation of the disc-like member.

According to a second aspect, a cardboard packer is provided. The cardboard packer comprises a flap folding unit according to the first aspect.

According to a third aspect, a method for performing flap folding is provided. The method comprises feeding an unfolded flap to pass a convex portion of a disc-like member thereby urging the flap to fold. Once the flap has passed the convex portion, the method performs rotation of the disc-like member such that a recessed portion of the disc-like member is facing a transport area of one or more flaps, and once an unfolded rear flap has passed the recessed portion, the method performs rotation of the disc-like member such that the convex portion will accelerate and reach the rear flap from behind, causing the rear flap to fold.

The method may further perform final rotation of the disc-like member for returning the disc-like member to its idle position where the convex portion is ready to engage with a passing front flap.

According to a fourth aspect, a non-transitory computer-readable storage medium is provided, storing one or more programs configured for execution by one or more processors. The one or more programs comprises instructions for controlling the position of a disc-like member such that a passing unfolded flap engages with a convex portion of the disc-like member thereby urging the flap to fold, and once the flap has passed the convex portion, for controlling rotation of the disc-like member such that a recessed portion of the disc-like member is facing a transport area of one or more flaps, and once an unfolded rear flap has passed the recessed portion, for controlling rotation of the disc-like member such that the convex portion will accelerate and reach the rear flap from behind, causing the rear flap to fold.

Still other objectives, features, aspects and advantages of the invention will appear from the following detailed description as well as from the drawings.

BRIEF DESCRIPTION OF THE DRAWINGS

Embodiments of the invention will now be described, by way of example, with reference to the accompanying schematic drawings, in which.

DETAILED DESCRIPTION

Figure 1:
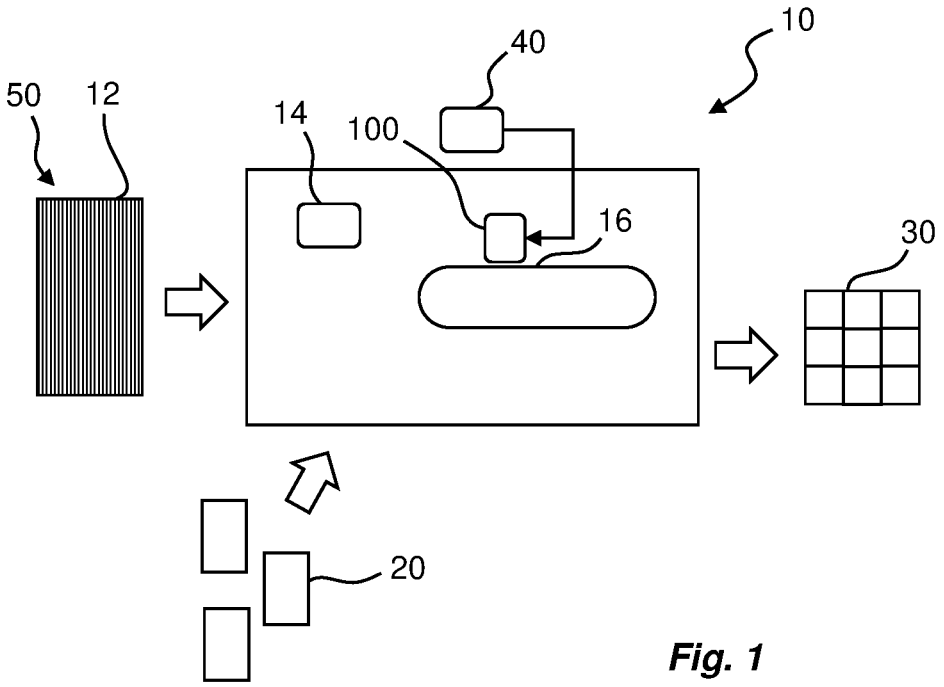
FIG. 1 is a schematic view of a cardboard packer according to an embodiment.

With reference to FIG. 1 a cardboard packer 10 is illustrated. The cardboard packer 10 is configured to transform a cardboard blank to a cardboard package, as will be explained in the following.

The cardboard packer 10 is fed with a blanks magazine 12. The magazine 12 contains a number of separate blanks, stacked on top of each other in the magazine 12. The cardboard packer 10 is also receiving a flow of individual packages 20, such as carton packages 20 filled with a liquid food product or other suitable content, may it be in solid form or in liquid form.

The cardboard packer 10 comprises a blank picker 14 which is configured to access the magazine 12 and to grip one blank 50 at the time, and to move the blank 50 from the magazine 12 to a blank feeder 16. The blank feeder 16 is preferably configured to perform initial folding and forming of the blank towards the final cardboard package 30. Hence, the feeder 16 is in some way configured to also receive the carton packages 20, and to arrange the carton packages 20 within the cardboard package 30.

A flap folding unit 100 is provided along the transport path of the feeder 16. As is clear from FIG. 1, the cardboard packer 10 also includes a control unit 40 for controlling the operation of the flap folding unit 100, at least.

Figure 2:
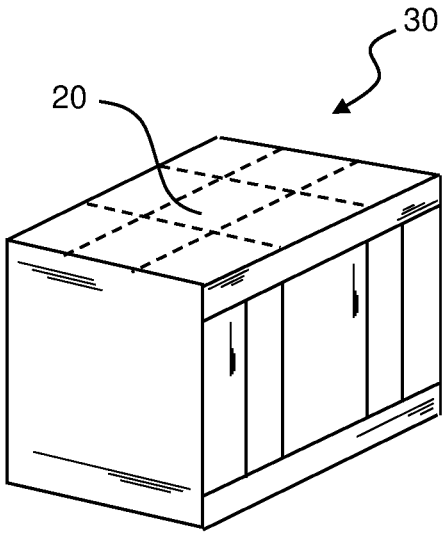
FIG. 2 is an isometric view of a cardboard package produced by a cardboard packer.

In FIG. 2 a cardboard package 30 is shown. The cardboard package 30 is representing only one example of how a blank 50 can be formed into an enclosing structure for a plurality of individual packaging containers 20 (in this example 12 pieces).

Figure 3:
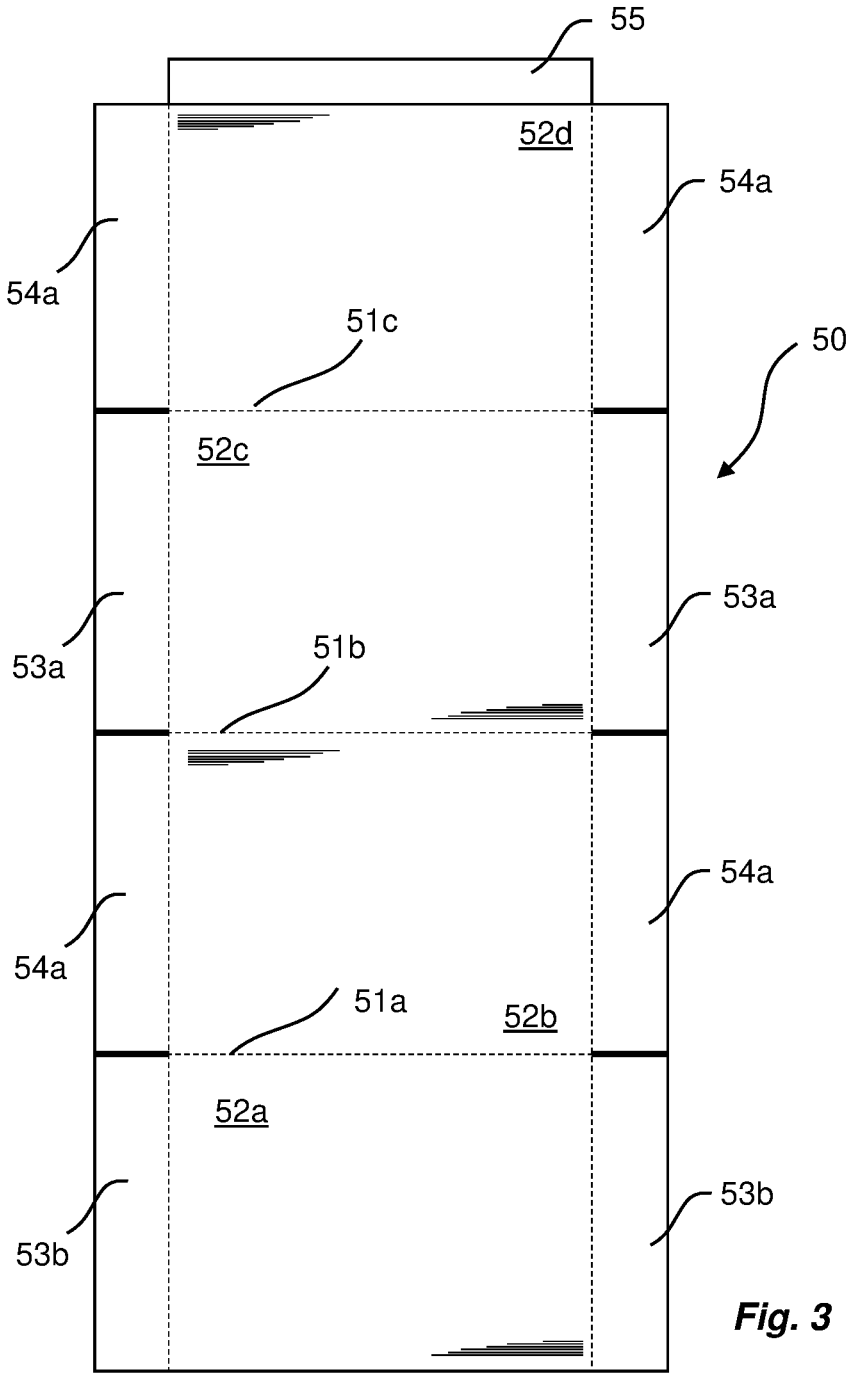
FIG. 3 is a top view of a blank to be fed to a cardboard packer, and to be used to form a cardboard case.

In FIG. 3 an example of a cardboard blank 50 is shown. The cardboard blank 50 is in the form of planar sheet, comprising a plurality of features to assist in forming the blank 50 into a three-dimensional body.

A first crease line 51*a* is arranged transverse to separate a rear panel 52*a* from a bottom panel 52*b*. Similarly, a second crease line 51*b* is arranged in parallel, but spaced apart from the first crease line 51*a* to separate the bottom panel 52*b* from a front panel 52*c*. A third crease line 51*c* is arranged in parallel, but spaced apart from the first and second crease lines 51*a-b* to separate the front panel 52*c* from a top panel 52*d*.

The blank 50 is provided with a plurality of flaps 53-55. Front flaps 53*a* extend laterally on each side of the front panel 52*c*, while rear flaps 53*b* extend laterally on each side of the rear panel 52*a*. Bottom flaps 54*a* extend laterally on each side of the bottom panel 52*b*, while top flaps 54*b* extend laterally on each side of the top panel 52*d*. Yet further, a closing flap 55 is extending longitudinally from the top panel 52*d*.

Now turning to FIGS. 4*a-d*, the process of forming a cardboard case is schematically illustrated. It should be noted that the described process is configured for blanks 50 of the type shown in FIG. 3; should other blanks 50 be used, the process of forming a cardboard case may be adjusted.

Figure 4A:
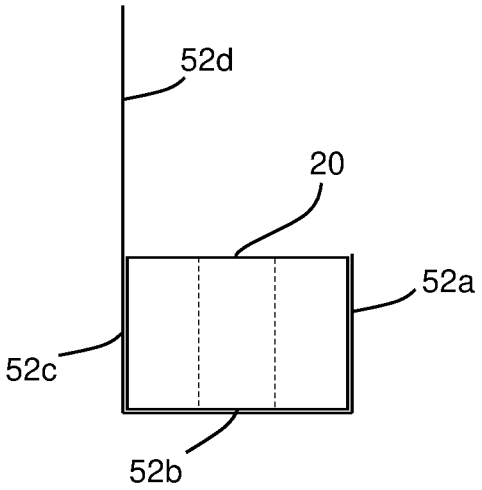
FIGS. 4*a-d* are schematic side views of how a cardboard blank is transformed to a cardboard case by means of a cardboard packer according to an embodiment.

In FIG. 4*a* a plurality of packaging containers 20 are positioned onto the bottom panel 52*b* of the blank 50. The rear panel 52*a* and the front panel 52*c* are folded approximately 90° from the bottom panel 52*b*.

Figure 4B:
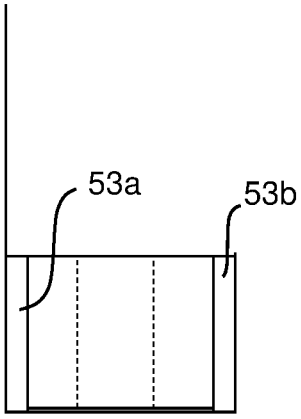

In FIG. 4*b* it is shown how the front flaps 53*a* and the rear flaps 53*b* have been folded inwards, towards the packaging containers 20.

Figure 4C:
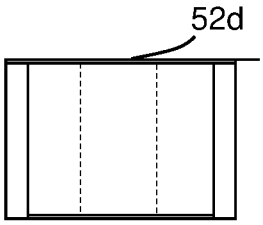

In FIG. 4*c*, the top panel 52*d* is folded downwards and towards the upper portion of the packaging container 20.

Figure 4D:
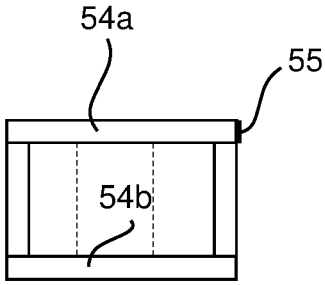

In a last step, shown in FIG. 4*d*, the top flaps 54*b* are folded downwards while the bottom flaps 54*a* are folded upwards. Also, the closing flap 55 is folded downwards. Optionally, the top flaps 54*b* and the bottom flaps 54*a* are sealed to the front and rear flaps 53*a-b*, and the closing flap 55 may be sealed to the rear panel 52*a*.

Now, with reference to FIG. 5 and onwards, details of the flap folding unit 100 will be given. The flap folding unit 100 is configured to fold the front and rear flaps 53*a-b* of the blank 50, although it should be understood that the flap folding unit 100 could be used to fold any kind of suitable flap.

Figure 5:
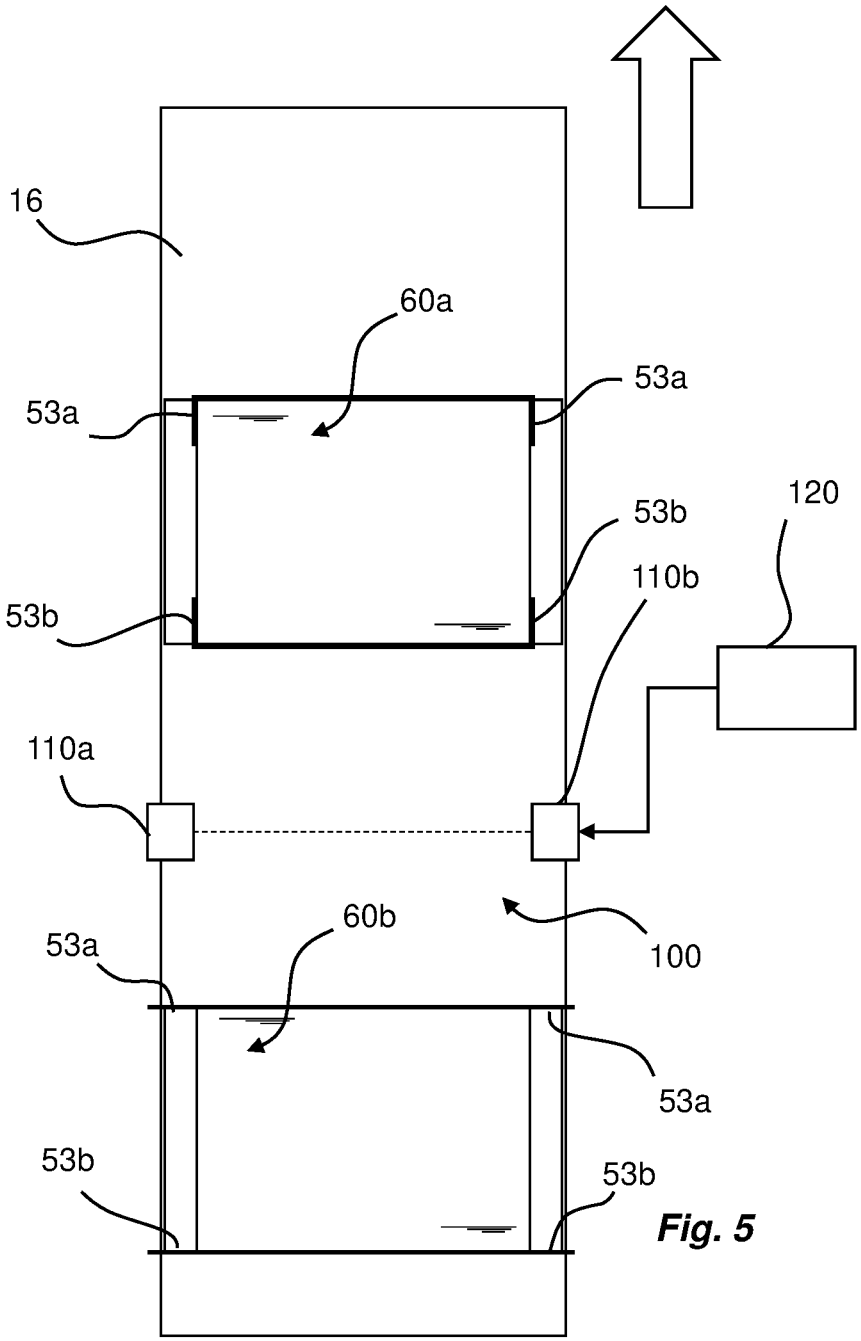
FIG. 5 is a top view of a parts of a cardboard packer, having a flap folding unit according to an embodiment.

In FIG. 5 a schematic top view of the feeder 16 is shown; the transport direction is indicated by the block arrow. The feeder 16 receives a flow of blanks 50 (as shown in FIG. 1), and the blanks 50 are transformed into closed cardboard cases 60 during their transport along the feeder 16. Hence, as indicated in FIG. 5 a leading soon-to-be-formed cardboard case 60*a* is followed by a trailing soon-to-be-formed cardboard case 60*b*.

The flap folding unit 100 is arranged along the transport path of the feeder 16. In particular, the flap folding unit 100 comprises a first flap folding device 110*a* on a first side of the feeder 16, and a second flap folding device 110*b* on the opposite side of the feeder 16.

As can be seen in FIG. 5, the trailing cardboard case 60*b* is arranged with its front and rear flaps 53*a-b* still unfolded. However, once the cardboard case passes the flap folding unit 100, the front and rear flaps 53*a-b* will be folded due to the action of the flap folding unit 100. This is illustrated for the leading cardboard case 60*a*.

As will be explained in the following, operation of the flap folding unit 100 is controlled by means of a controller 120. The controller 120 forms part of the flap folding unit 100, or is connected thereto, in order to transmit control signals to driving components of the flap folding unit 100.

Figure 6:
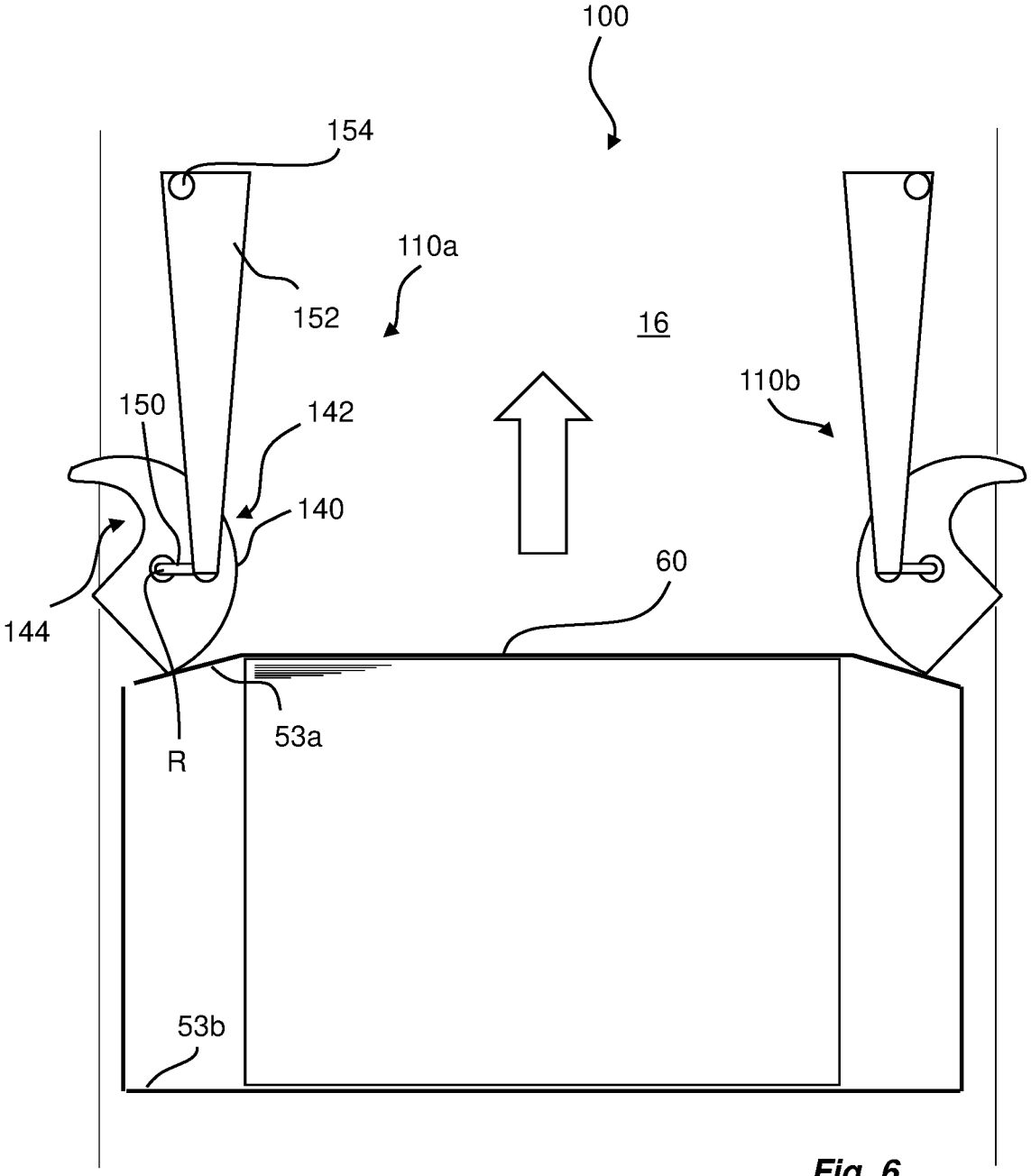
FIGS. 6-10 are schematic top views of the flap folding process according to an embodiment.

The flap folding unit 100 is shown in FIG. 6. The flap folding unit 100 comprises a first flap folding device 110*a* and a second flap folding device 110*b*. The flap folding devices 110*a-b* are arranged on opposite lateral sides of the feeder 16, such that the first flap folding device 110*a* will act on one side of the cardboard case 60, while the second flap folding device 110*b* will act on the opposite side of the cardboard case 60.

As can be seen in FIG. 6, the flap folding devices 110*a-b* are identical, at least with regards to how they act on the cardboard case 60 and engage with the respective flaps 53*a-b*.

Figure 11:
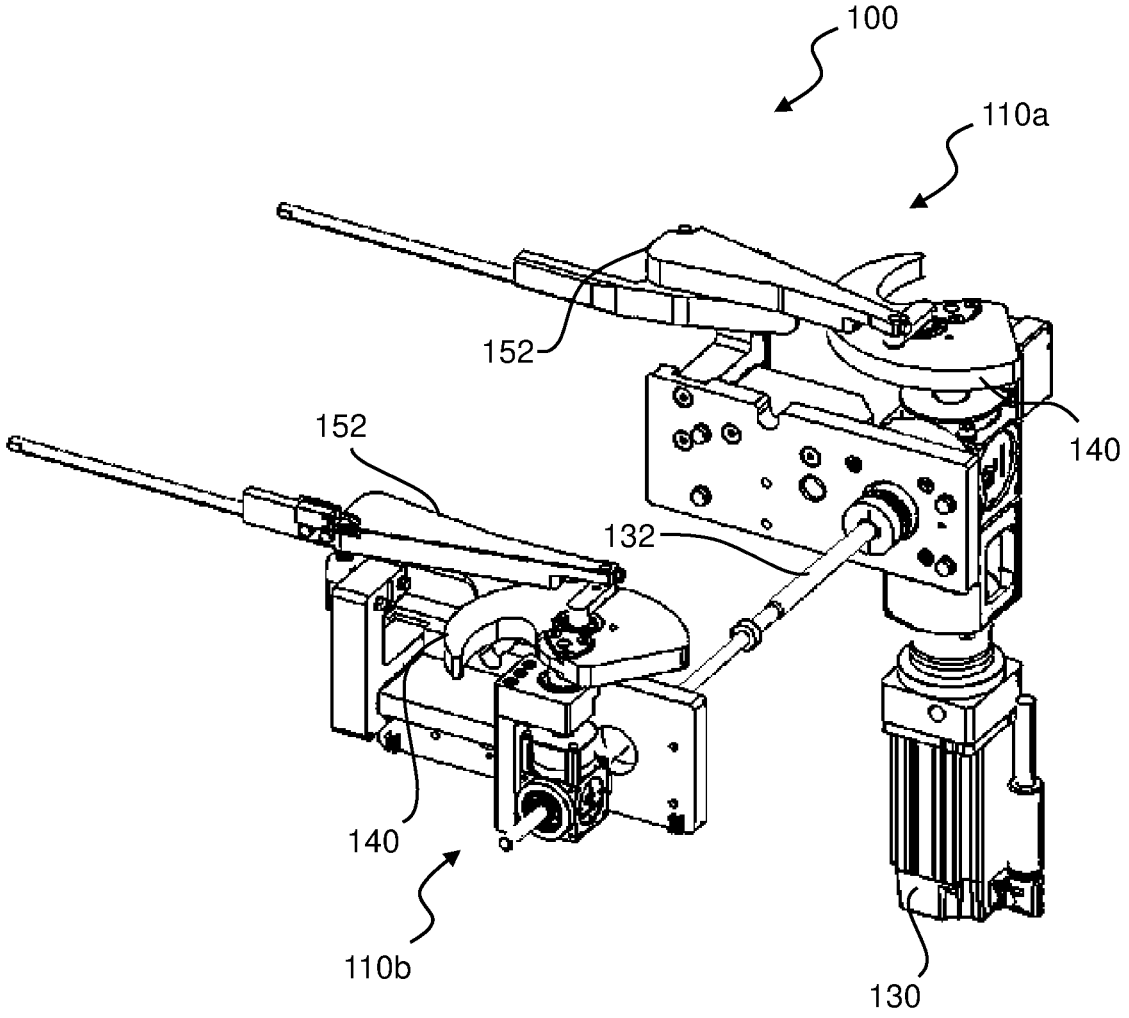
FIG. 11 is an isometric view of a flap folding unit according to an embodiment.

As will be further explained with regards to FIG. 11, the flap folding unit 100 comprises a drive means 130, preferably in the form of an electrical motor. The electrical motor 130 is powered by a power supply (not shown), and the electrical motor 130 is connected to the controller 120 to receive control signals.

Again referring to FIG. 6, a flap folding device 110*a-b* comprises a disc-like member 140. Reference numerals are only inserted for the left flap folding device 110*a*, although the other flap folding device 110*b* comprises the same components.

The disc-like member 140 has a convex portion 142 and a recessed portion 144. The convex portion 142 is preferably a section of a circular periphery, while the concave portion 144 is a cut-out from the circular periphery. As shown in FIG. 6, the convex portion 142 extends slightly less than 180°. However, other extensions of the convex portion 142 are also possible. The recessed portion 144 has a curved shape, such that the disc-like member 140 exhibits a claw shape.

The disc-like member 140 is rotationally supported, and driven by the electrical motor 130. The rotational axis of the disc-like member 140 is preferably coinciding with the center point of the disc-like member 140; otherwise the convex portion 142 would move in an eccentric motion, possibly not supporting the flap 53*a* after it has been folded.

At the position of the rotational axis R, the disc-like member 140 is rotationally connected to a pivoting lever 150, which in turn is connected to a link arm 152. The link arm 152 extends substantially in parallel with the feeder 16, i.e. parallel to the direction by which the cardboard case 60 is transported. However, as the disc-like member 140 rotates by activation of the electrical motor 130, the pivoting lever 150 will pivot thereby causing the link arm 152 to pivot as well. The direction of the link arm 152 will thereby deviate slightly from a strict parallel alignment with the longitudinal axis of the feeder 16. As can be seen in FIG. 6, the link arm 152 is pivotally supported by means at a pivot joint 154 arranged off-center the longitudinal axis of the link arm 152.

As the cardboard case 60 is approaching the flap folding unit 100, the front flaps 53*a* (still being unfolded) will come into contact with the convex portion 142 of the disc-like member 140. During this motion of the cardboard case 60, the disc-like member 140 is kept stationary. Due to the convex shape of the disc-like member 140, i.e. the convex portion 142 is located such that the flaps 53*a* will engage with it, the flaps 53*a* will be urged to fold as the cardboard case 60 moves forward.

Figure 7:
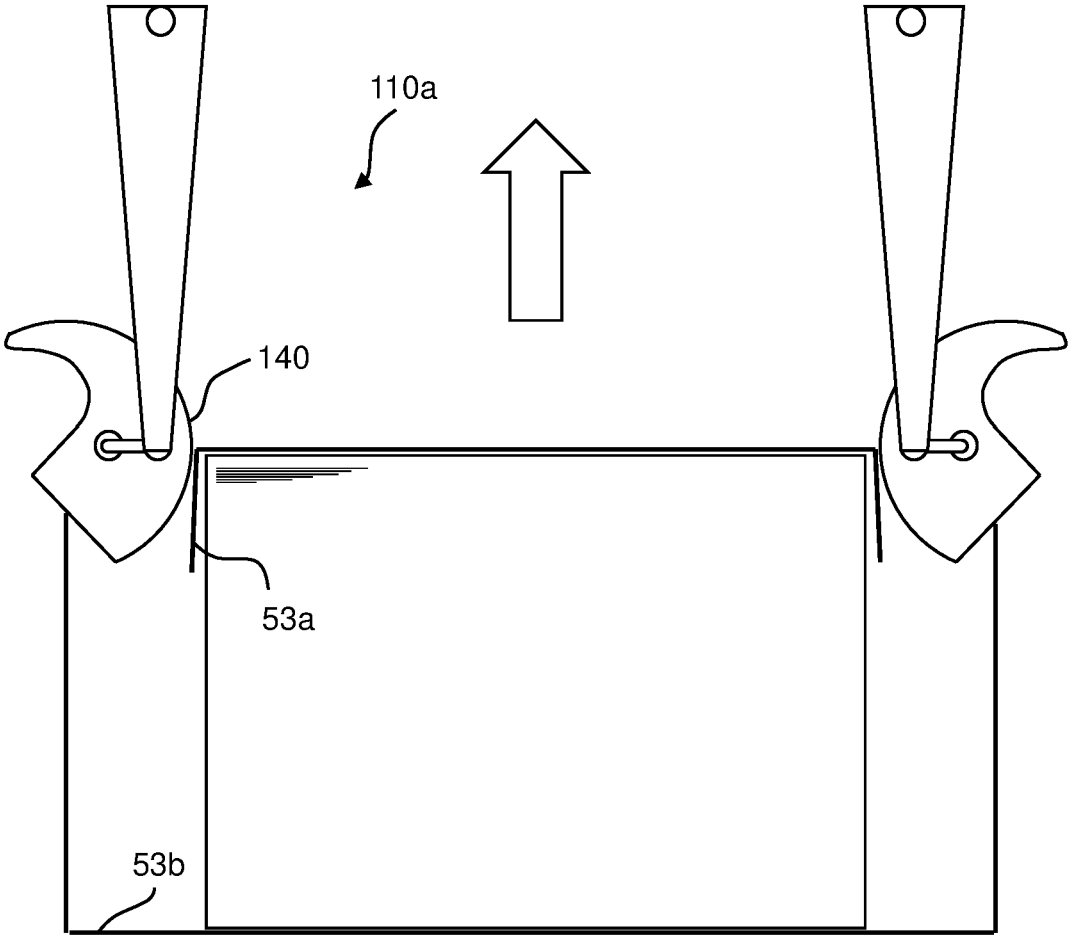

A subsequent position of the cardboard case 60 is shown in FIG. 7. In this position the feeder 16 has moved the cardboard case 60 to a position where the front flaps 53*a* have been folded entirely by the curved portion 142 of the disc-like member 140. So far, the disc-like member 140 has not rotated.

Figure 8:
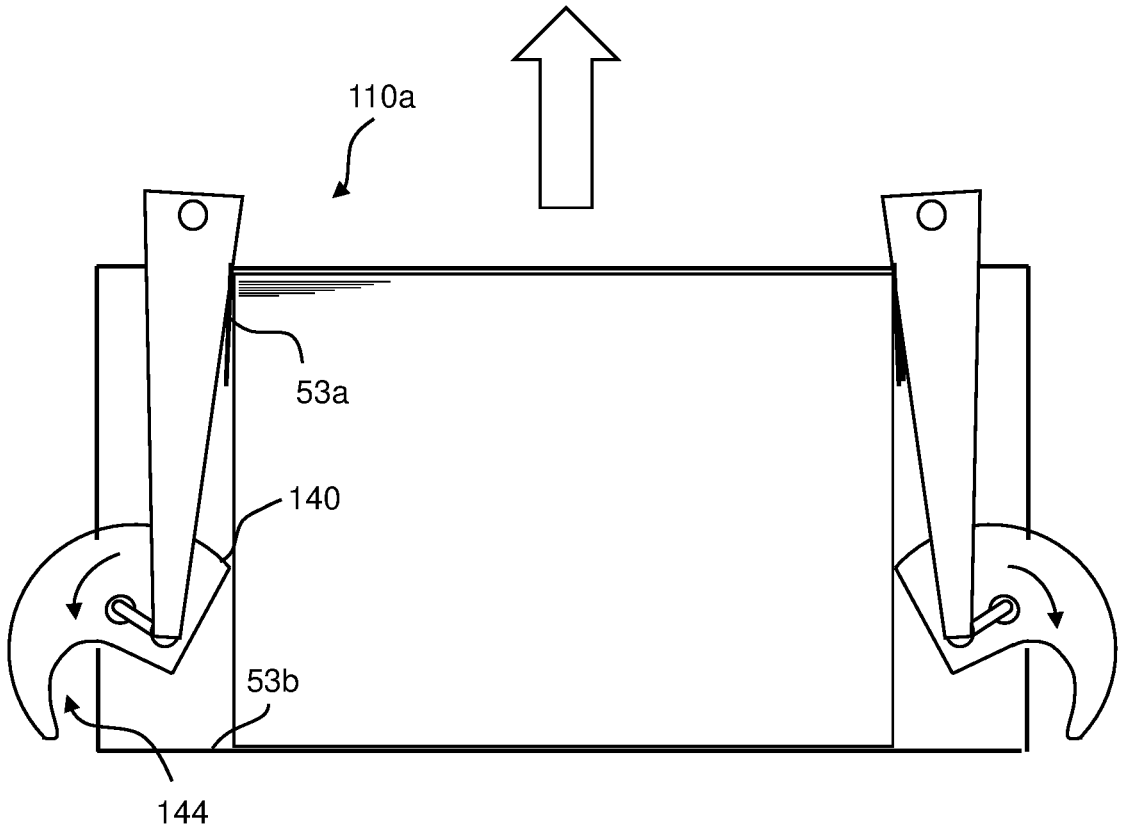

Once the cardboard case 60 has moved to a position where the front flaps 53*a* have been fully folded, i.e. immediately after the position shown in FIG. 7, the disc-like member 140 is kept stationary in order to support and guide the loaded packaging containers to secure that they do not move out from the cardboard case 60. When the rear flaps 53*b* are approaching the disc-like members 140, the disc-like members 140 are rapidly rotated such that the rear flap 53*b* can pass the recessed portion 144 of the disc-like member 140. Hence, the rotation of each disc-like member 140 is synchronized with the motion of the rear flaps 53*b*, which also means that it will be possible to adjust the motion of the flap folding devices 110*a-b* for different sizes of the cardboard case 60. This is shown in FIG. 8. The disc-like member 140 has rotated slightly more than 90° from its position shown in FIG. 7.

Figure 9:
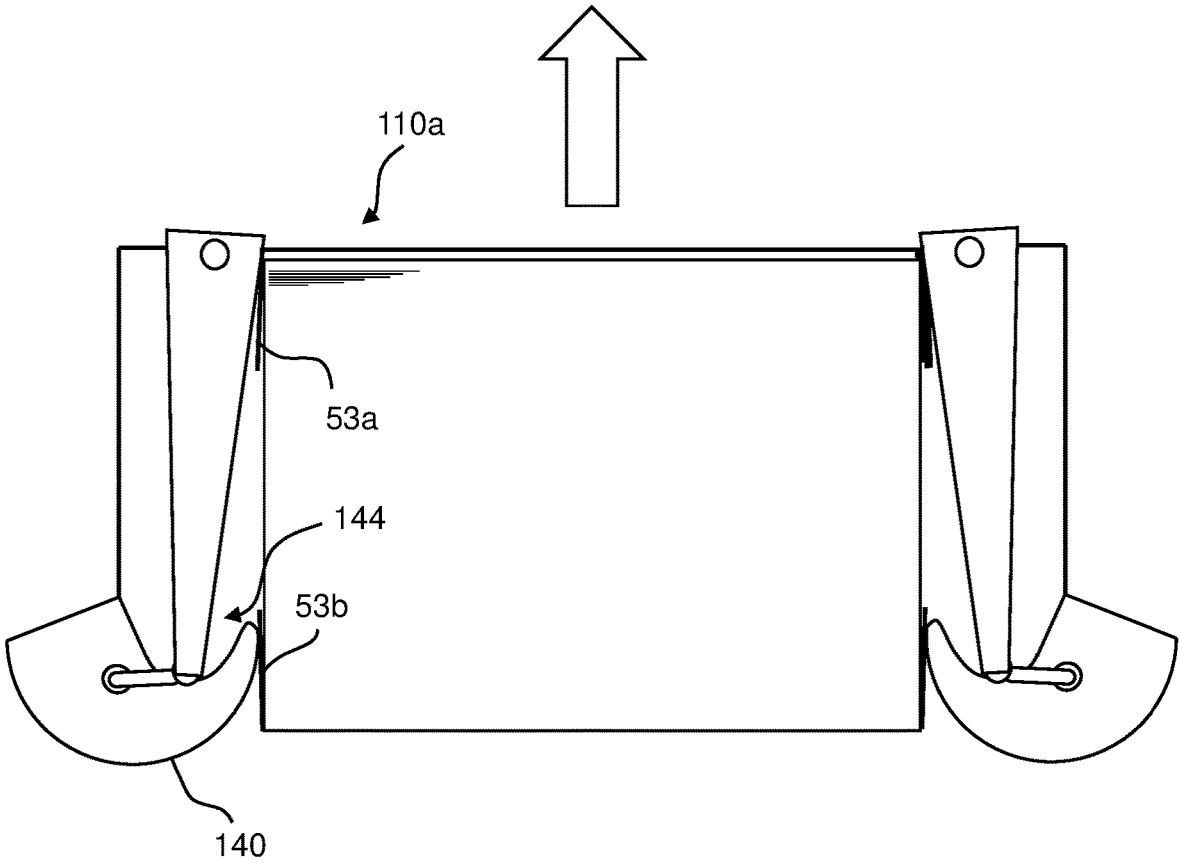

The flap folding device 110*a* is programmed, preferably by means of the controller 120, to perform a fast rotation of the disc-like member 140 from the position shown in FIG. 8, in a direction indicated in FIG. 8. As the cardboard case 60 moves forward, the convex portion 142 will accelerate and reach the rear flaps 53*b* from behind as is shown in FIG. 9. As the convex portion 142 moves faster than the cardboard case 60, the rear flaps 53*b* will be urged to fold in a forward direction as the cardboard case 60 moves forward, and as the disc-like member 140 pushes the flaps 53*b* in the forward direction at a speed greater than the speed of the cardboard case 60. When the disc-like member 140 reaches its initial position (i.e. the angular position shown in FIG. 6), the rear flaps 53*b* are fully folded and the rotational movement of the disc-like member 140 is stopped.

The same motion sequence is repeated for subsequent cardboard cases 60 being transported by the feeder 16.

Figure 10:
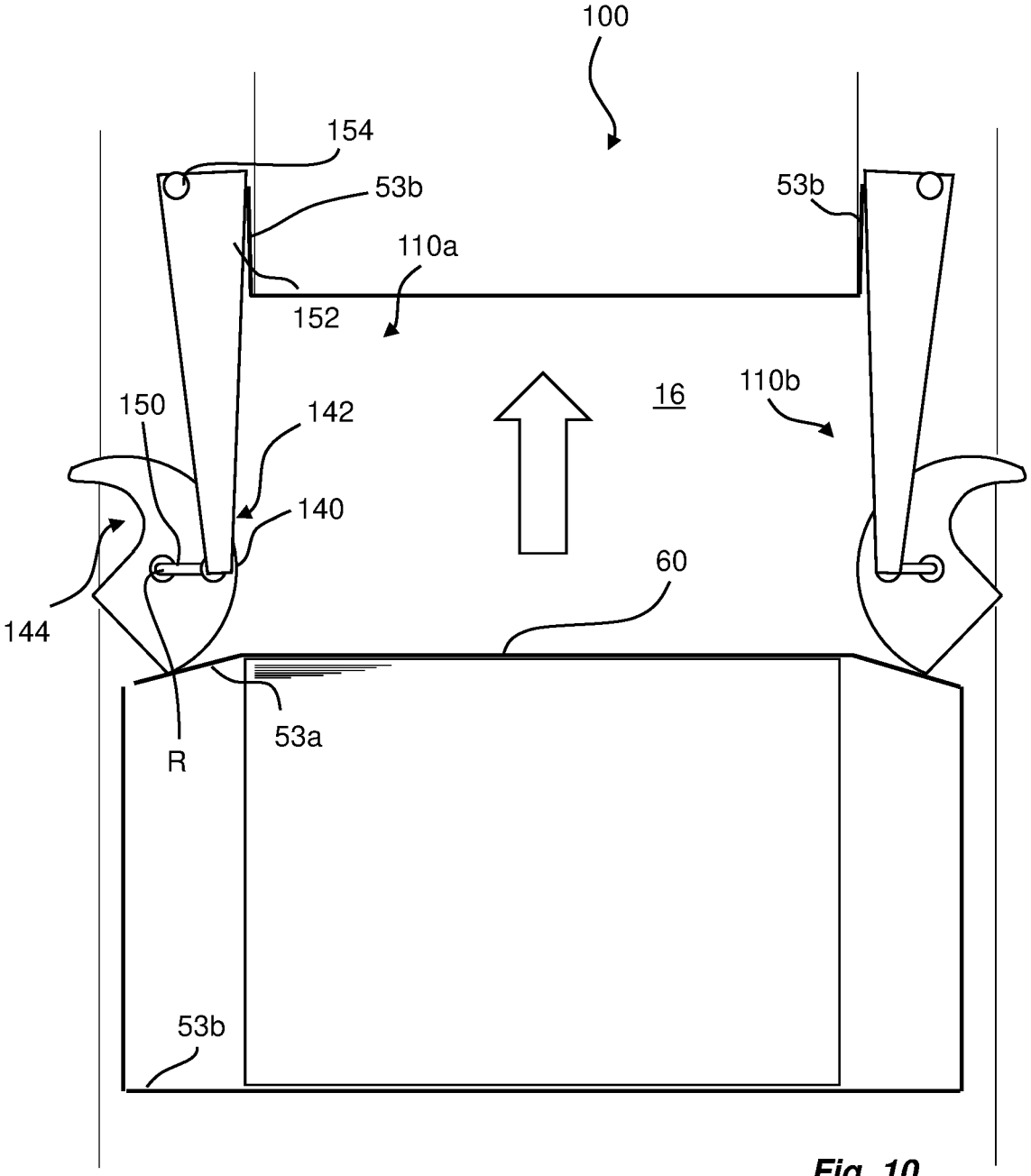

The link arm 152 will assist in keeping the flaps 53*a-b* folded as they pass the disc-like member 140. As the front flaps 53*a* have been folded, they will be in contact with an inner side of the respective link arm 152 in order to assist in maintaining the folded position of the front flaps 53*a*. However, folding of the rear flaps 53*b* will also be assisted due to the shape of the link arm 152. In particular, with reference to FIG. 10 there will be a leading cardboard case in front of the cardboard case 60. As the cardboard case 60 is stationary on the feeder 16 such that packaging containers are allowed to be loaded onto the yet unfolded cardboard case 60, the leading cardboard case will be positioned such that the link arm 152 keeps the rear flaps 53*b* of the leading cardboard in their folded position. Of course, other means may be implemented for keeping the flaps in their folded position, such as linear motors that generate a pushing movement in the direction transverse to the direction by which the cardboard case 60 is transported, to push and keep the flaps against the case 60. Thus, the link arms 152 represents one of several embodiments for keeping the flaps in place.

Now turning to FIG. 11, an embodiment of a flap folding unit 100 is shown separate from the feeder etc. The flap folding unit 100 has a first flap folding device 110*a* and a second flap folding device 110*b*. Each flap folding device has a disc-like member 140, as described earlier with reference to FIGS. 6-10. The first flap folding device 110*a* is driven by means of an electrical motor 130. However, the first flap folding device 110*a* is connected to the second flap folding device 110*b* by means of a rotational shaft 132, such that rotation of the disc-like member 140 of the first flap folding device 110*a* is also transmitted to the second flap folding device 110*b*, thereby causing the disc-like member 140 of the second flap folding device 110*b* to rotate as well. For the transmission, worm gears or similar can be used. Instead of a mechanical transmission, it would also be possible to use separate motors for each flap folding device 110*a-b*.

Figure 12:
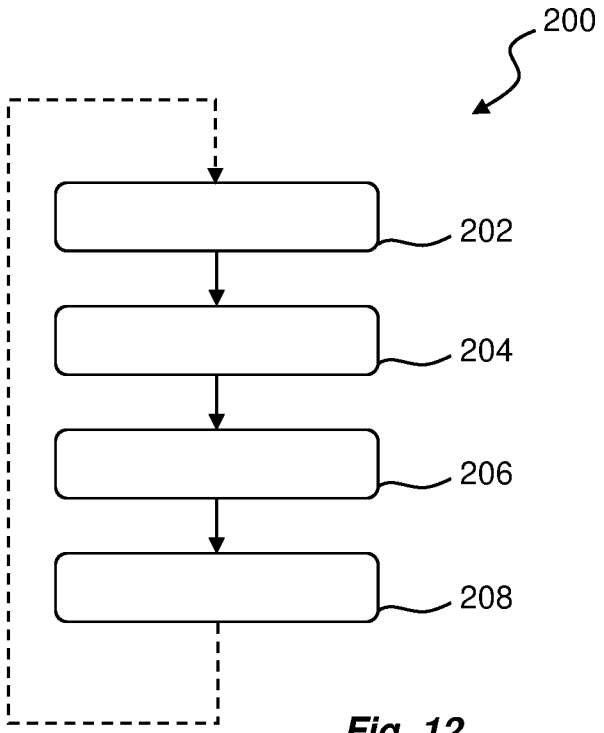
FIG. 12 is a schematic view of a method for a cardboard packer.

Now turning to FIG. 12, a method 200 for flap folding is schematically shown. The method 200 comprises a first step 202 of feeding an unfolded flap 53*a* to pass a convex portion 142 of a disc-like member 140 in order to cause folding of the flap 53*a*. The convex portion 142 is preferably stationary during this step, although a rotational movement may also be considered. As soon as the folded flap 53*a* is transported beyond the convex portion 142, the method 200 performs a step 204 of rotating the disc-like member 140 such that a recessed portion 144 of the disc-like member 140 is arranged in a position facing a feeder 16. As an unfolded rear flap 53*b* is approaching, it will be allowed to pass the disc-like member 140 by no contact due to the provision of the recessed portion 144. As soon as the unfolded rear flap 53*b* has passed the recessed portion 144, the method 200 performs a step 206 of rotating the disc-like member 140 such that the convex portion 142 will accelerate and reach the rear flaps 53*b* from behind. Upon further rotation of the disc-like member 140, the rear flap 53*b* will be folded.

After performing step 206, the method 200 will perform a step 208 of continued rotation of the disc-like member 140 for returning the disc-like member 140 to its idle position where the convex portion 142 is ready to engage with a passing front flap 53*a*.

The method 200 is repeated in order to perform flap folding of a sequence of passing articles, preferably cardboard cases 60 as described previously.

From the description above follows that, although various embodiments of the invention have been described and shown, the invention is not restricted thereto, but may also be embodied in other ways within the scope of the subject-matter defined in the following claims.

The invention claimed is:

1. A flap folding unit, comprising at least one flap folding device having a disc-like member being configured to be arranged in a first position to urge passing front flaps of an associated cardboard case to fold, and in a second position to allow unfolded rear flaps of the associated cardboard case to pass the disc-like member, the disc-like member comprising a convex portion and a recessed portion, the disc-like member being connected to a link arm, and the link arm extending substantially parallel with a cardboard case feeder, the convex portion being located at one portion of an outer periphery of the disc-like member and the recessed portion being located at a different portion of the outer periphery of the disc-like member.

2. The flap folding unit according to claim 1, wherein the convex portion has a partly circular periphery.

3. The flap folding unit according to claim 1, wherein the disc-like member moves from the first position to the second position through rotation of the disc-shaped member in a rotational direction, the disc-shaped member being is configured to rotate in the rotational direction from its second position toward its first position, thereby urging rear flaps of the associated cardboard case to fold.

4. The flap folding unit according to claim 1, wherein the link arm is pivotally supported.

5. The flap folding unit according to claim 1, comprising a pair of spaced apart flap folding devices.

6. The flap folding unit according to claim 5, wherein the flap folding devices of said pair of flap folding devices are arranged on opposite sides of a feeder.

7. The flap folding unit according to claim 5, comprising an electrical motor configured for driving said pair of flap folding devices.

8. The flap folding unit according to claim 5, wherein the flap folding devices of said pair of flap folding devices are driven in a synchronized fashion.

9. The flap folding unit according to claim 1, further comprising a controller being configured to control rotation of the disc-like member.

10. The flap folding unit according to claim 9, comprising a feeder configured for conveying the cardboard case along a transport path, wherein the flap folding device is located along said transport path at a flapping station.

11. The flap folding unit according to claim 10, wherein the disc-like member of the flap folding device has a convex portion and a recessed portion, wherein in the first position of the folding device, the convex portion faces the cardboard case located at the flapping station and, in the second position of the folding device, the recessed portion faces the cardboard case located at the flapping station.

12. The flap folding unit according to claim 11, wherein when the front flaps are at the flapping station, the flap folding device is controlled by the controller in the first position, to fold the front flaps, when the rear flaps are at the flapping station, the flap folding device is firstly controlled by the controller in the second position, to allow the unfolded rear flaps to pass, and then the flap folding device is controlled by the controller in the first position, to fold the rear flaps.

13. The flap folding unit according to claim 9, wherein the flap folding device is positioned on a first side of the transport path at the flapping station and the flap folding unit comprises a further flap folding device positioned on a second side of the transport path at the flapping station, the second side being opposite to the first side.

14. A flap folding unit for interacting with unfolded front and rear flaps projecting from a cardboard case as the cardboard case moves along a transport path, the flap folding unit comprising:

a link arm positioned along the transport path and a rotatable disc-shaped member having an outer periphery, a first portion of the outer periphery of the disc-shaped member being a convex portion and a second portion of the outer periphery of the disc-shaped member being a recessed portion, the recessed portion and the convex portion being circumferentially spaced from one another, the disc-shaped member being connected to the link arm and being rotatable relative to the link arm to rotate: i) from a first position in which the convex portion of the disc-shaped member contacts the unfolded front flap of the cardboard case while the cardboard case is being moved along the transport path to urge the front flap to fold; and ii) to a second position in which the recessed portion allows the unfolded rear flap of the cardboard case to pass by the disc-like member.

15. The flap folding unit according to claim 14, further comprising a motor operatively connected to the disc-shaped member to rotate the disc-shaped member from the first position to the second position.

16. The flap folding unit according to claim 14, wherein the disc-shaped member is rotatable about a rotation axis that passes through the disc-shaped member, the disc-shaped member having a center point that coincides with the rotation axis.

17. The flap folding unit according to claim 14, wherein the link arm is pivotally supported at a pivot joint.

18. The flap folding unit according to claim 14, wherein the disc-shaped member is connected to the link arm by way of a pivoting lever.

* * * * *